US006335477B1

(12) United States Patent
Miller

(10) Patent No.: US 6,335,477 B1
(45) Date of Patent: Jan. 1, 2002

(54) MUSICAL INSTRUMENT PICKS AND NOVEL METHODS OF USE

(76) Inventor: Frederic Smith Miller, 913 Vine St., Louisville, KY (US) 40204

( * ) Notice: Subject to any disclaimer, the term of this patent is extended or adjusted under 35 U.S.C. 154(b) by 0 days.

(21) Appl. No.: 09/281,687

(22) Filed: Mar. 30, 1999

Related U.S. Application Data

(60) Provisional application No. 60/081,416, filed on Apr. 11, 1998.

(51) Int. Cl.[7] ..... G10D 3/16
(52) U.S. Cl. ..... 84/322; 84/320; 84/321
(58) Field of Search ..... 84/320, 321, 322; D17/20, 22

(56) References Cited

U.S. PATENT DOCUMENTS

| | | | | | |
|---|---|---|---|---|---|
| 315,135 | A | | 4/1885 | Farris | |
| 388,519 | A | | 8/1888 | Ahlquist | |
| 401,476 | A | | 4/1889 | Barnes | |
| 408,052 | A | * | 7/1889 | Stoll | 84/322 |
| 557,293 | A | | 3/1896 | Wahl | |
| 558,797 | A | | 4/1896 | Gery et al. | |
| 756,348 | A | | 4/1904 | Forney | |
| 1,009,403 | A | | 11/1911 | Gaynor | |
| 1,184,561 | A | | 5/1916 | Napolerano | |
| 1,296,284 | A | | 3/1919 | Gilman | |
| 1,444,982 | A | | 2/1923 | Orth | |
| 1,557,476 | A | | 10/1925 | Kimball | |
| 1,690,860 | A | | 11/1928 | Gonzalez | |
| 1,741,285 | A | | 12/1929 | Carpenter | |
| 1,787,136 | A | | 12/1930 | Beauchamp | |
| 2,016,438 | A | * | 10/1935 | Kealoha | 84/322 |
| 2,045,571 | A | | 6/1936 | Dopyera | |
| 2,063,011 | A | | 12/1936 | Bell | |
| 2,221,234 | A | * | 11/1940 | Frasier | 84/322 |
| 2,234,224 | A | | 3/1941 | Bay | |
| 2,776,592 | A | | 1/1957 | Di Preta | |
| 3,442,169 | A | | 5/1969 | Bowers | |
| 3,648,558 | A | | 3/1972 | Chenette | |
| 3,650,172 | A | | 3/1972 | Osborne | |
| 3,699,838 | A | | 10/1972 | Montgomery | |
| 3,735,663 | A | * | 5/1973 | Cowell, Sr. | 84/322 |
| 3,739,681 | A | * | 6/1973 | Dunlop | 84/322 |
| 3,789,720 | A | | 2/1974 | McIntyre | |
| 4,020,732 | A | * | 5/1977 | Kelly | 84/322 |
| 4,102,234 | A | * | 7/1978 | Brundage | 84/322 |
| 4,122,746 | A | | 10/1978 | Freeman | |
| 4,150,601 | A | | 4/1979 | Henley | |
| 4,270,433 | A | | 6/1981 | Adamec | |
| 4,347,773 | A | | 9/1982 | Zook | |

(List continued on next page.)

OTHER PUBLICATIONS

Bobri, Vladimer *The Segovia Technique* MacMillan, 1978 pp. 48, 49.
ProPik Fingertone (Advertisement) *Guitar World Acoustic* No. 26 1998 p. 90.
Alaska Pik (Advertisement) *Fingerstyle Guitar* May/Jun. 1998 No. 27 p. 34.

*Primary Examiner*—Robert E. Nappi
*Assistant Examiner*—Kim Lockett

(57) ABSTRACT

Securable instrument picks for uses as thumbpicks (10) and/or fingerpicks (10) providing a string-actuating tip (20) to the side of a distal phalange (14) for a conjoined engagement of the string-actuating tip and the distal phalange against a string (42). The actuating tips may be off-set cantilevered in the character of their securement to the distal phalange, whereby a pressure resulting from an up- or downstroke upon the string is carried through the pick and delivered against the upper or lower pads, respectively, of the distal phalange. The provided picks facilitate a novel method of use in which the fingertip-flesh of the distal phalange and the string-actuating tip may be conjoined together in a stroke against the string. The provided picks also facilitate a method of producing flatpicking-type musical effects by up- and downstrokes of a single finger, tilted sideward toward the strings.

20 Claims, 20 Drawing Sheets

U.S. PATENT DOCUMENTS 4,625,616 A * 12/1986 McVicker ..... 84/322
D291,809 S * 9/1987 Jasper ..... D17/20
4,741,239 A 5/1988 Crafton
4,867,032 A 9/1989 Lukehart
4,879,940 A 11/1989 Pereira
4,993,300 A 2/1991 Ejen
4,993,301 A * 2/1991 De Los Santos ..... 84/322
D317,617 S * 6/1991 Mutti ..... D17/20
5,323,677 A * 6/1994 Knutson ..... 84/322
D356,593 S * 3/1995 Purcell ..... D17/20
5,509,341 A * 4/1996 Dunlop ..... 84/322
5,610,349 A * 3/1997 Fogarty et al. ..... 84/322
5,837,913 A 11/1998 Newman
5,856,627 A 1/1999 George
5,859,377 A 1/1999 Mackey et al.
5,864,075 A * 1/1999 Mapson ..... 84/322
5,942,704 A 8/1999 Weldon
5,973,243 A * 10/1999 Christenson ..... 84/322
5,981,857 A * 11/1999 Mapson ..... 84/322
6,054,643 A 4/2000 Chance et al.
6,118,058 A 9/2000 Rowley
6,127,613 A 10/2000 Hansel

* cited by examiner

MUSICAL INSTRUMENT PICKS AND NOVEL METHODS OF USE

This application claims priority from my pending U.S. Provisional Patent Application Ser. No. 60/081416, filed Apr. 11, 1998, and is incorporated herein by reference.

BACKGROUND—FIELD OF INVENTION

This invention relates to a pick for sounding the strings of musical instruments and to a method of its use. More particularly, the present invention provides a type of pick for sounding the strings of musical instruments which is securable to the fingers and thumb of a player's hand so that a string-actuating tip is positioned to a side of the fingers and thumb to sound strings.

BACKGROUND OF THE INVENTION

Several types of musical instrument picks are well-known in various forms. These types of picks include thumbpicks, flatpicks, and fingerpicks. These types of picks are generally associated with particular methods for their respective use. That is, thumbpicks and fingerpicks are typically associated with fingerpicking methods, and flatpicks are typically associated with flatpicking methods. However, fingerpicking may also be performed without picks, thumbpicks may be grasped and used in the manner of a flatpick, and a flatpick can also be held and combined with fingerpicking strokes of the remaining fingers. The various methods and picks are commonly understood to have unique advantages and limitations, relative to particular musical contexts and purposes. Moreover, players frequently alternate between, or intercombine the use of the known picks and methods. Persons skilled in the art will therefore appreciate that a novel and effective type of pick may provide various players with novel advantages including a range of intercombinational possibilities with the known picks and methods.

The method of playing classical guitar is strongly associated with Andres Segovia, whose pedagogy is referred to here. In the classical method the strings of the instrument are engaged and sounded by a combined stroke of the natural fingertip and fingernail, and a "minimum transition" from flesh to nail is stressed as an ideal form of the playing stroke. The position of the hand in relation to the strings supports the implementation of this stroke, and the precise character of this stroke serves as a key, or reference point in the method, relative to other strokes employed for variation. The classical method is advantageous in that this stroke has a distinct feel for the player, which facilitates consistent articulation of notes, and tonal control.

Disadvantages of the classical guitar method include the problems of maintaining the nails. The different relation of the thumb toward the strings may produce uneven tones when the thumb is employed in alternation with strokes of a finger against a string. The natural nails may also produce thin tones on steel strings, which are customarily strung at greater tension than nylon strings. Players who use the classical method may be reluctant to play upon steel strings because of detrimental effects to their nails. And players who have learned the precisely combined classical stroke, described above, frequently find conventional fingerpicks and thumbpicks intolerably clumsy and imprecise to use. It is therefore desirable to provide a type of pick which facilitates a precise, combined stroke of the flesh and a string-actuating tip, and also that such a stroke be generally adaptive to the hand position of the classical method. It is advantageous for such a pick to permit and protect the maintenance of playing-length nails. It is also desirable for a thumbpick to be employed with strokes of the natural fingers to balance the tones produced alternately by the fingers and thumb, when such a method may be musically advantageous. Those persons skilled in the art will recognize from the foregoing discussion that the classical method is one to which the known types of fingerpicks and thumbpicks are generally least adaptive. Therefore, the preceding discussion is provided as exemplary of some of the deficiencies of known picks and methods.

The known types of fingerpicks provide an actuating tip either in the general form and position of the natural fingertip, or else in the general form and position of the fingernail.

The former type which will be referred to as fingertip-type fingerpicks sacrifices the sensitivity of the natural fingertip contacting the string. This makes it difficult to avoid buzzing a string which is vibrating from a prior stroke, and difficult also for the player to feel the relative pressure of the stroke upon a string, to control that stroke in volume and tone. The loss of sensitivity is especially problematic for classical players in this regard, because the classical hand position "floats" over the strings, rather than being anchored on the instrument by the little finger, as in some other methods. Maintaining orientation toward and among the strings is heavily dependent in this regard upon the sense-memory of the fingers.

In U.S. Pat. No. 5,981,857, 1999, Mapson discloses a fingerpick provided with an evacuated area, or hole, in the area of the fingertip, prior to the termination of the string-actuating tip. This provision is disclosed as permitting an advantageous alternation between soft tones, produced by the action of the fingertip where it is exposed by the hole, with stronger tones produced by the action of the provided tip. It may also be intended that a degree of fingertip contact is thus provided, for players who may prefer it. However, the provision of the hole necessarily requires that the player engage the string by the fingertip at sufficient depth to touch the string prior to the sounding stroke-release of the picking tip, if it is used. There may also be found an undesirable raking sound, as the hole terminates prior to the tip, especially if the fingertips are calloused, if the inner edge of the hole engages the string. The action of the fingertip and the pick cannot be made simultaneous nor effectively co-active, if the player desires it so, by this provision. The production of tones cannot be controlled by a relative co-action of flesh and actuating tip upon strings, but rather, as it is expressed, by alternation of these surfaces. It is therefore desirable that a solution be provided whereby a simultaneous engagement of a string by a fingertip and a co-acting tip is facilitated, which also provides for a simultaneous stroke-release of a string when such is desired.

A second general type of fingerpick includes those which provide a tip in the form and position of the fingernail. These will be referred to as fingernail-type fingerpicks. Some of the limitations of these are inherent in the necessity that the imitation nail must overlay the natural nail. The imitation nail must be longer than the natural nail, or the natural nails must be clipped shorter than would be effective for playing purposes. Many players would not sacrifice their nails, even temporarily, to use fingerpicks or false nails. The classical method stresses a "minimum transition" from flesh to nail, and fingernail-type fingerpicks generally increase that transition, as they are not inset in the finger at the side, like the natural nail, but overlaid by their own thickness and that of the nail.

U.S. Des. Pat. No. 356,593, 1995 by Purcell describes a design of fingernail-type picks which provide a nail-like ridge of material to fit under the natural nail. While this addresses the concern of minimal transition from flesh to nail, some players may find it too discomforting to have such a ridge in the tender area under the nail. These picks are ineffective for downstrokes insofar as they are braced upward against the nail, but are easily displaced by any downward pressure. A type of fingerpick is desirable which provides an analogous but distinct sort of combined stroke of the flesh and a rigid material, so that the natural stroke could be retained for its own sake, separately. It is desirable also that such a pick be provided with a securement means adaptive for both up- and downstrokes.

In addition to fingernail-type picks which have securement portions in the form of a ring-shaped band, many players use false-fingernails such as are also commercially available for cosmetic purposes. An advantage of this type of fingernail-pick is that it requires no securement-band of material encircling the finger, which may be felt to encumber the motion of the finger. A tip is provided in imitation of that of the natural nail, with a material extension portion likewise imitating the form of a nail, which is securable onto the nail of the digit typically by an adhesive glue. Such picks are often preferred by players who primarily use their natural nails, and are unaccustomed to the feel and use of known fingerpicks, but who may need to repair a natural nail which is broken. Thus they are often used in selective combination with use of the natural nails of other digits.

A disadvantage of adhesive false-nails is that they cannot be rapidly and easily applied and removed, or adjusted, but considerable trouble must be taken to effect a repair, when, as in a performance situation, a facile and immediate replacement might be desired. False-nails typically imitate the use of the natural nails, rather than providing biomechanical improvement of the natural relation of the fingertip and nail in respect to the combination of nail and flesh surfaces upon a string. While the form and position of the natural nail is very adaptive for use on lower tension strings having relatively large diameters, such as nylon strings, finer gauges of steel strings can often snag between the fingertip and nail. It is therefore desireable that an instrument pick be provided which prevents the snagging of fine strings under the edge of the nails. It is desirable also that an instrument pick be provided which is more adaptive to the methods of using nails than are the known sorts of fingerpicks, and which may function as nail-protectors for players who use nails; which advantages moreover may enhance their effectiveness as facile replacements for damaged nails. Such a pick may further be desired to effect enhancement of the close connection of tip-and-flesh surfaces upon strings, in forms as wearable picks having securement bands, or as adhesive picks having none.

Both of the known sorts of fingerpicks are frequently found to have disadvantages relating to their securement on the fingers. Fingerpicks are often perceived as being too loose for effective playing, or being too tight for comfort, or both at once. It is therefore desirable that a fingerpick be provided which is adjustable to fit comfortably when not engaged in playing a stroke, but which responds to the pressure of its tip against a string, whether upward or downward, by binding more tightly when engaged, then relaxing again subsequent the stroke. Such a mechanical provision might also desirably reduce the motion of the finger necessary to perform the stroke, thus enhancing speed and fluency.

Thumbpicks such as are generally well known provide a tip extending laterally to the side of the thumb, which engages a string in a downstroke and binds more firmly in response to the pressure of the stroke. A disadvantage of these thumbpicks is that they dislodge when performing upstrokes. Another disadvantage is that the tip extension lateral to the side of the thumb is disoriented from the touch of the natural thumb against a string, in form, position, and the habitual motions of playing. A player who uses the bare thumb on some occasions must adapt to the use of a thumbpick, in that the forward edge of the bare thumb, furthest from the fingers, is employed to engage strings. Thumbpicks typically present a tip sideward, away from the fingers, and well behind the tip of the thumb. This position of a tip for engaging strings makes it necessary to perform extra, semi-circular motions of the thumb, as the tip is inserted between and among the strings to be played. But at the same time, this position of a tip laterally sideward of the thumb reduces the range of picking motions axial to the hand, which can be performed by the thumb independently. Therefore it is desirable to provide a thumbpick which combines the sensitivity of the natural thumb in its stroke, and which is adaptive to use in a manner like the use of the natural thumb alone. Such a thumbpick is furthermore desired to bind more firmly when performing either up- or downstrokes.

In the foregoing discussion of the known types of securable instrument picks and their uses the classical guitar method has been used as an example to demonstrate various limitations of the known picks. Those skilled in the art will no doubt appreciate also that these and other deficiencies may pertain in greater or lesser degrees, relative to particular musical purposes and contexts. This being generally the case, it would be desirable moreover that a novel type of instrument pick be embodied in forms which permit the user to alter, adapt, and experiment with the application of the picks as tools.

Certain disadvantages of known fingerpicking methods pertain also to flatpicking techniques. Persons having injuries of the thumb or hand who cannot hold a pick nor combine downstrokes of the thumb with upstrokes of the fingers are unable to play a sufficient range of musical effects by either method to make playing worthwhile. The method of playing generally known as tapping may provide a useful alternative. Advances in amplification facilitate the application of weaker sorts of attacks upon strings, such as tapping the string with a finger, as a basis for playing music. But while this method may be effective in many musical contexts, it cannot produce the characteristic sounds and effects of a great deal of music for stringed instruments. It would therefore be desirable to provide a method of producing such effects as are generally associated with flatpicking methods, for example, but which depended on initiating motions producible by one independent finger.

OBJECTS OF THE INVENTION

In accordance with the foregoing discussion of the background of the present invention, it is an object of the present invention to provide securable instrument picks of a novel general type, adaptive to various uses as thumbpicks and as fingerpicks. A further object of this provision is to enhance the range of combinational possibilities between and among the conventional methods and means of playing instruments.

It is another object of the present invention to provide a novel playing stroke in which the sensitive flesh of the finger or thumb, and a provided string-actuating tip are combined in a variable, generally parallel relation, to co-actively engage against and strike a string or strings. It is a further object of this provision that many advantages associated with the classical guitar method may be appropriated and adapted to other types of musical instruments and contexts. It is also intended within the scope of this object that the customary means of performing the classical guitar method, in respect to considerations such as the length and condition of the nails, the customary positions and motions of the hand, may be largely preserved by a player, discreet from, and in accordance with the invented method. It is intended in the scope of the invented method that its advantages may be adopted in parts and particulars to various combinations with known methods. For example, the invented thumbpick might be used in combination with the use of the natural nails of the fingers, to balance the tones produced when the finger and thumb alternate in strokes upon strings. Or the invented fingerpicks may be used in combination with the use of a conventional type of thumbpick, etc.

It is still another object of the present invention to provide novel securements of a string-actuating tip to the distal phalange, particularly incorporating an off-set cantilever of the tip to the upper and/or lower surfaces of the phalange. It is an object of this provision to support up- and downstrokes with a securement which will bind firmly in the stroke, but will also relax when not engaged. It is also intended that some such securements may be broadly adaptable, so that players might variably deform a single embodiment to fit ideally upon a selected digit of their hand. Within the scope of this intention it is also considered that a single deformable embodiment of the pick may be very easily and inexpensively produced, and also easily obtained and applied to use by many players, whose requirements in regard to size and comfort are varied.

It is yet another object of the present invention to provide a form of the invented picks which is easy to deform and adapt in respect to its applications as a pick. For example, a form of the pick which may be cut from sheet polycarbonate by a steel-rule die, can also be readily cut in other sheet materials which may have advantageous qualities. Further, a pick of this sort which may for example be cut in sheet polycarbonate of 0.020 thickness may be variously deformed by a player by cutting with scissors, clipping with nail-clippers, filing, or bending, to effect various alterations in the fit and relative co-action of the string-actuating tip with the natural finger in applications against strings. It is intended that such variations in respect to tonal effects and the feel of the picks in use may be as much as possible be effected, controlled, and experimented with by the player. It is therefore a consideration of this object that some embodiments which may not inclusively provide all of the proposed advantages of the invention may nevertheless be preferred embodiments for the purpose of introducing their essential novelty to a broad range of players. An object is to provide an embodiment in which many of the advantages of the invention may be somewhat averaged, and which then, having been recognized, may be better effected by way of deformations to the embodiment, or by producing or obtaining other, more particularly adapted embodiments of the invented picks.

It is yet a further object of the present invention to provide a novel method of producing flatpicking-type effects upon stringed instruments, by up- and downstrokes against strings which may be initiated by motions of a single finger. This object also serves as an example of an enhancement of the combinational possibilities among known means and methods of playing, provided by the invented picks. Particularly, the novel provision of a string-actuating tip to the side of a finger facilitates this method, in which a finger is tilted with the actuating tip disposed toward the strings, so that up- and down motions of the finger carry the pick within a striking range of the strings, without flicking out and away from the strings in the downstroke. Within the scope of this object it intended to provide an alternative method for persons who may not be able to use conventional methods to play musical effects facilitated by this method. Within the scope of this object it is intended that this novel method may be employed discreetly, or in combinations with conventional methods. Various forms of the invented actuating tip provided to facilitate this method can be added as a discreet feature to, apparently, any other known type of fingerpick. The use of the method is therefore very broadly adaptive to combinations with the use of other methods, including the use of the bare fingertips.

In addition to fingerpicks and thumbpicks the prior art discloses many variants of wearable, or retainable, flatpicks. U.S. Pat. No. 5,973,243 issued 1999, to Christenson, discloses a wearable flatpick which is retained on a finger, such as the forefinger, to permit fingerpicking strokes by the fingertips while the provided pick is positioned discreetly from the fingertips and may be readily grasped by the thumb and finger for flatpicking purposes. This provision permits alternation of flatpicking and fingerpicking methods, especially for players who do not wish to use a thumbpick. Thumbpicks provide a tip which may also be employed for flatpicking purposes.

The Christenson pick distinguishes over wearable flatpicks such as may interfere or encumber the use of the fingertips for playing, such as a pick disclosed by Montgomery, U.S. Pat. No. 3,699,838, October, 1972. Montgomery proposes a pick to be worn on the distal phalange of a finger. The Christenson pick provides a tip in a position behind and above the fingertip, and integral, through an extension portion along the side of the finger, with a securement means on the middle, or dorsal phalange. Thus, the natural flexing of a finger when playing strokes further dislocates the string-actuating tip from the playing surfaces of the distal phalange.

A disadvantage of the Christenson pick is that many players prefer to position a flatpick in close connection with the distal phalange used to grasp it. Christenson contemplates that the pick may be deformed from its discreet position by the grasp upon the pick, but this may actually increase the fatigue of the fingers, which many wearable flatpicks propose to reduce.

It would therefore be desirable to provide a wearable flatpicking device which may also function as a fingerpicking device, by co-acting with, rather than encumbering the fingerpicking strokes of the fingertip and thumb-tip. Such a device would be desired to be substantially adhered to maintain a position of its tip relative the fingertip regardless of the flexing of the fingerjoints, and without requiring a thumb-and finger grasp. It would be desirable moreover that such a device may present a surface portion, rather than an edge toward a string in a stroke by an unsupported finger, and that the device be such that its use on any one or more of the digits will not impede their independent motions.

In general, those skilled in the art will appreciate that instrument picks are a difficult area for innovation, because of the habitual and practiced nature of playing motions. Most players will prefer to use the picks or methods they learned with, or a close variant. It is therefore desirable that a novel or alternative instrument pick may provide elements adaptive to the known forms and methods of playing, and to various uses such as fingerpicks, thumbpicks, and securable flatpicks, whereas its unique aspects and further advantages may be further discoverable by players over time.

In summary of the objects and advantages of the present invention, it is an object to provide an instrument pick comprising a string-actuating tip having an extension portion for securing and maintaining said tip by a means onto a distal phalange; said tip being a material form disposed in a position substantially to the side of said distal phalange, and having a surface presentation terminating toward said tip in such relation that a substantially parallel and co-planar surface presentation of said distal phalange toward the tip of said phalange may thereby also substantially engage against a string in an action of a stroke by said instrument pick and said phalange.

Further objects and advantages are apparent in respect to the foregoing discussion of the background of the invention. Still further objects and advantages will become apparent from a consideration of the ensuing description and drawings. The particular examples and applications given should not be construed as limiting the scope of the invention.

SUMMARY OF THE INVENTION

The present invention provides an instrument pick for various uses as a thumbpick, fingerpick, or wearable flatpick. The pick provides a string-actuating tip securable onto a distal phalange of a digit of a hand, in a position to the side of the distal phalange, whereas a thumb-and-finger grasp is not required to maintain the pick required to maintain the pick in use. The invented picks provide for novel methods of use including a combined stroke of the actuating tip and the surface of the distal phalange against a string or strings. Another novel method is the production of both up- and down-strokes by the motions of a single digit with the hand tilted sideward toward the strings. The invented picks provide means for facile combination of its novel methods together, and with other methods.

DETAILED DESCRIPTION OF THE PREFERRED EMBODIMENTS

Figure 1A:
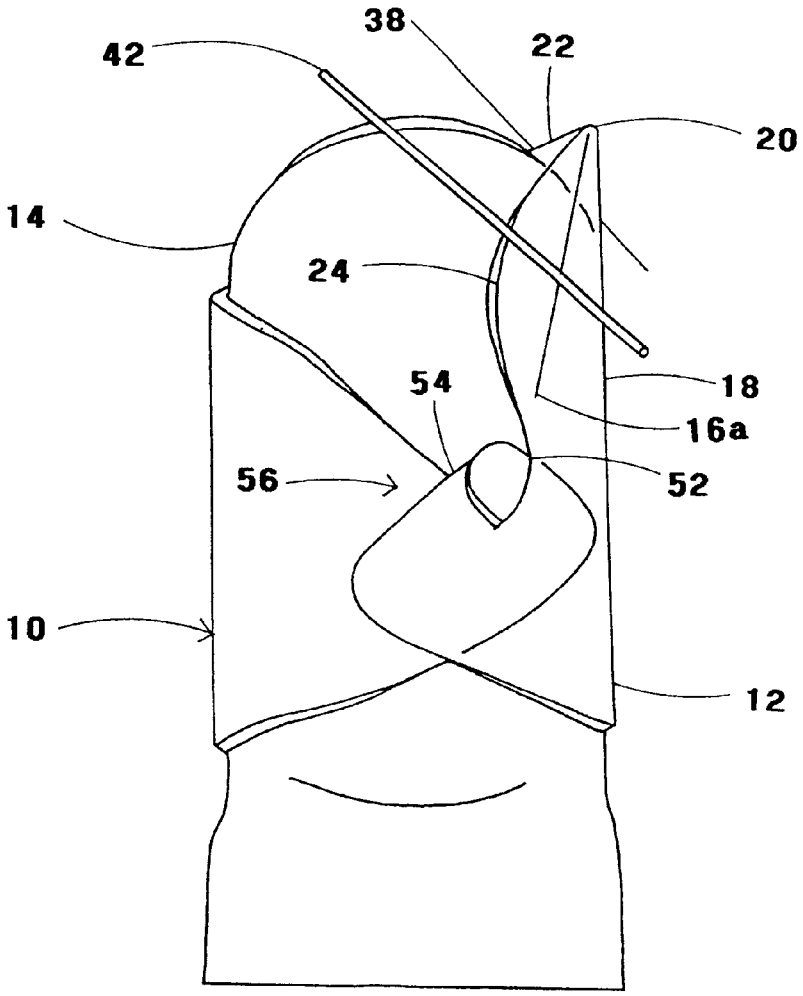
FIG. 1*a* shows a preferred embodiment of a securable instrument pick mounted on a distal phalange in a view toward the fingerprinted lower surface of the phalange.
Figure 1B:
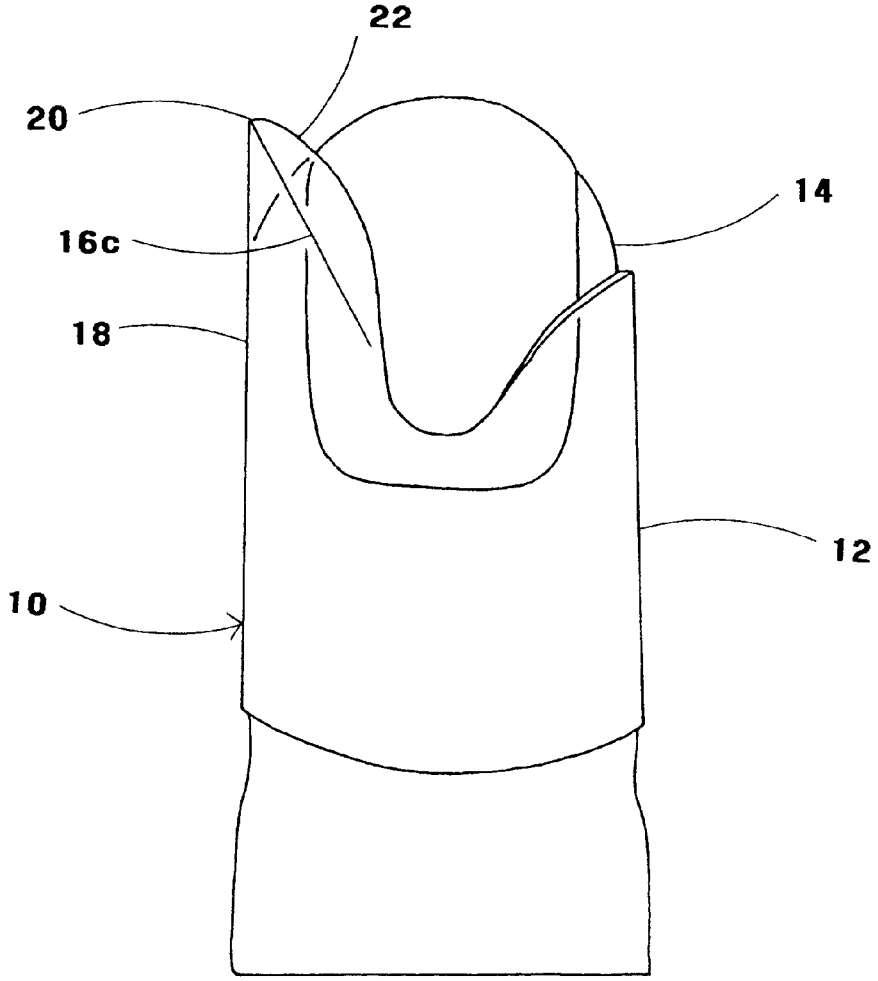
FIG. 1*b* shows the securable instrument pick mounted on a distal phalange in a view toward the fingernailed upper surface of the phalange.

Referring to FIG. 1*a,* a pick 10 according to a preferred embodiment of the present invention is secured to a distal phalange 14, for example, an index finger or thumb, by means of a ring-shaped band 12 having an interlocking clasp 56. The interlocking clasp 56 comprises a primary opposable notch 52, and a secondary notch 54 which is shown in this example in a position under the primary notch 52.

The pick 10 provides a forward extension 18 from the band 12 toward a string-actuating tip 20 to a side of the phalange 14. The string-actuating tip 20 comprises; a lower surface presentation 24 in a position co-active with a surface of the phalange 14 in the action of a stroke upon a string 42; and an upper surface presentation 22. The material of the pick may be understood to be transparent in this example. The upper surface presentation 22 is shown in this view toward its undersurface, as is toward the phalange 14, whereas the lower presentation 24 is shown in a view of its outer surface away from the phalange 14, with an aspect of its edge in view. An articulated memorable bend 16*a* inclines the lower surface 24, thus integrally faceted with the forward extension 18, toward the termination of the actuating tip 20.

A line 38 indicates the general position occupied by the tip 20, as it is extraneous to the form and position of the natural phalange 14. This area adjacent the forward taper of the phalange 14 is of particular interest to various embodiments of the invented picks in respect to the provision of such tips to the side of a phalange as will not encumber motions of an adjacent finger.

The preferred embodiments shown in FIGS. 1*a*–3*b* are formable from sheet materials, such as, for example, sheet polycarbonate plastic having a thickness of 0.020, or other materials having sufficient resilience and memory may alternatively be used. This and other embodiments might be produced in various other ways, or in other materials such as metals, but the preferred embodiment in sheet plastic material is especially easy and inexpensive to produce with few tools.

Figure 1C:
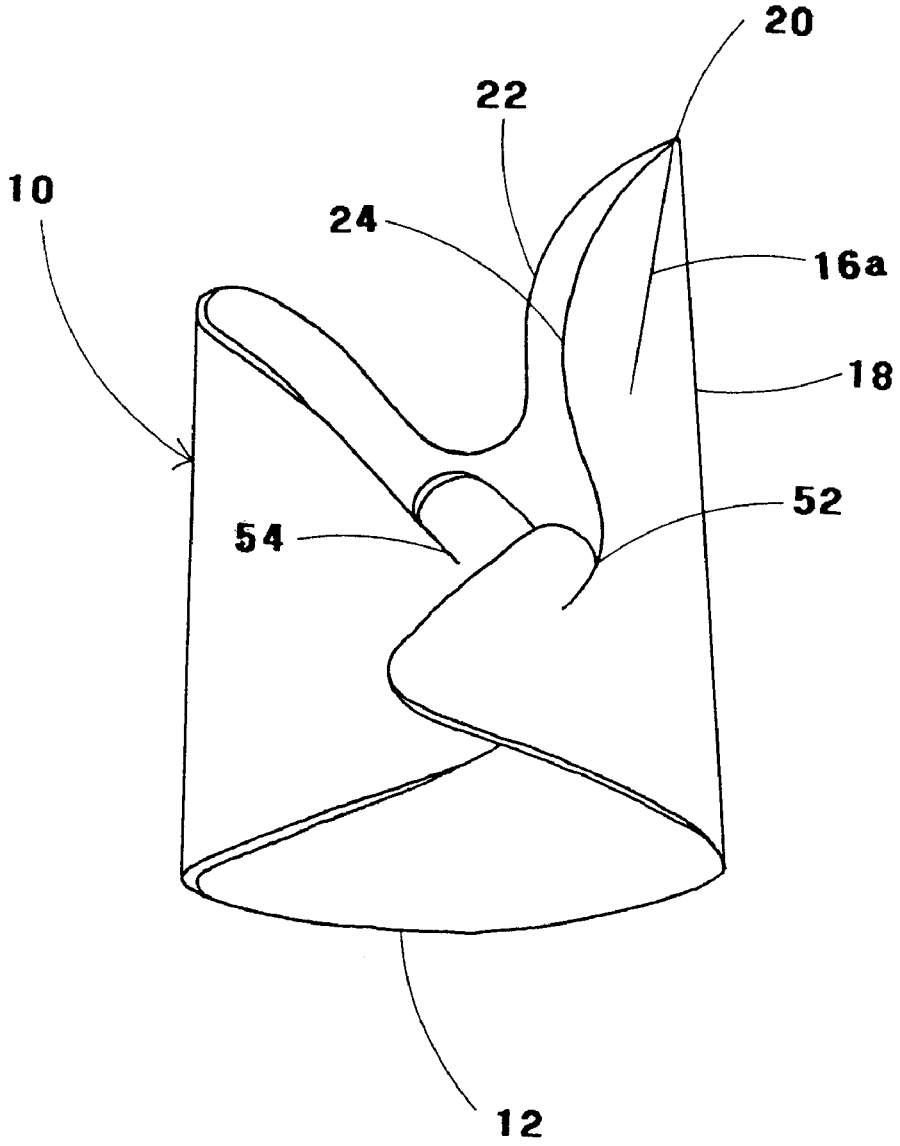
FIG. 1*c* shows a perspective view of the pick having a primary opposable notch and a secondary notch.
Figure 1D:
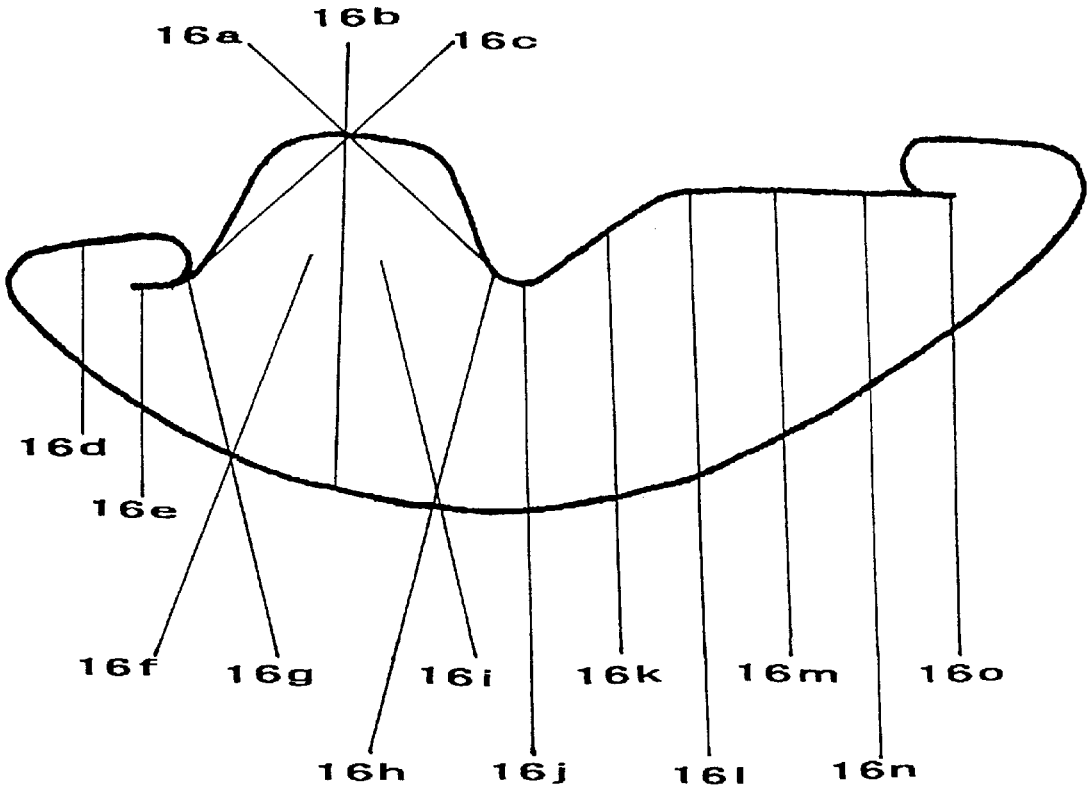
FIG. 1*d* shows an exploded view of the pick with an exampled pattern of articulated memorable bends.

The exploded view of the securable instrument pick 10 shown in FIG. 1*d* may be used as an example of a pattern for cutting a model of a pick from such sheet material, as indicated by the outer contours illustrated. The scale of the drawing and its relative dimensions are provided as an example, and should not be construed as limiting the scope of the invention. Articulated memorable bends 16*a,* 16*b,* 16*c* are effected in the shaped piece of sheet material generally as indicated to form a string-actuating tip 20 having a lower surface presentation 24, and an upper surface presentation 22 integral with a forward extension 18 from the material of the securement element 12. The bends 16*a–c* must be acute enough to effect memory in the material, and they may be adjusted more particularly in the process of fitting the pick.

In some materials such as the example of 0.020 polycarbonate it is preferred that additional bends be placed, as generally exampled by lines 16*d,* 16*e,* 16*f,* 16*g,* 16*h,* 16*i,* 16*j,* 16*k,* 16*l,* 16*m,* 16*n,* 16*o,* to deform the sheet material to fit around the distal phalange 14. It has been found that if polycarbonate sheet is flexed into such a form, without articulate memorable bends, the material will become brittle over time, and may crack or break. The suggested bends overcome this, as do other methods of forming the pick in such plastics, such as injection molding. This method, again, is especially easy to accomplish. The bends 16*d–o* may vary greatly in respect to their number, and placement. They may overlap, criss-cross, may extend to an opposite side of the sheet material, or only partly from an edge, as indicated by the exampled bends 16*f,* 16*i.* They may also be pinched more acutely, or flattened to relatively less acute degrees—all of which may affect the comfort or feel of the pick. In respect to forming the picks it may be found expedient to fit the ring portion by another adhesive means, simply to try the action of the pick, before forming an integral clasp. This facilitates experimentation with forming the picks, without the additional trouble of forming a clasp.

An example of a desirable adaptation of the bends is the placement of a bend where the material may uncomfortably overlay a hangnail; this bend can be pinched relatively more acutely to defer pressure from that area, greatly enhancing the comfort of the securement.

It may be necessary to flatten the bends 16*d–o* so that the opposed notches 52 and 54 will be held together by integral memory, in an interlocking clasp 56. The pick can simply be counter-flexed against the bends to accomplish this, and usually it will be found necessary only in respect to some larger sizes of the picks.

All the bends 16*a–o* are effected in the same direction. Which direction can be readily understood from the Figures, generally, although it may be noted that reversing the direction will produce a reverse pick, which is also useful for some applications, although the placement of the tips to the thumbward side is more generally preferred. The traditional hand position for playing the lute, for example, is particularly adaptive to employing tips on the side of the fingers furthest from the thumb. The invented picks can obviously provide tips to either, or even to both sides of a phalange. But the reversed pick is also effective in the preferred manner for use by an opposite hand. Thus a right-handed or left-handed pick may be produced.

Figure 2A:
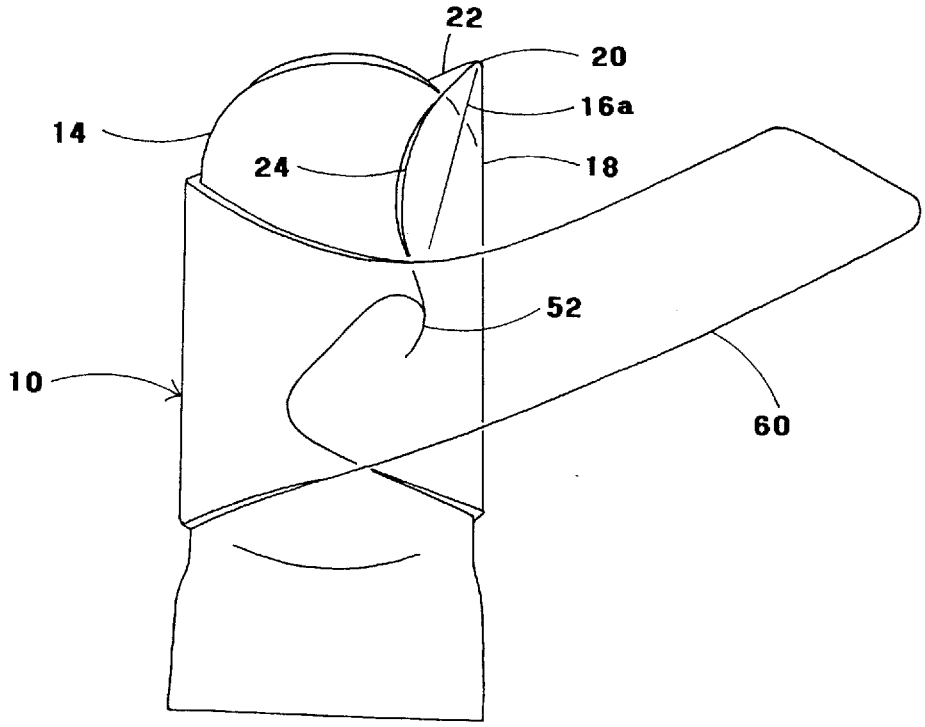
FIG. 2*a* shows a securable instrument pick such as may be variably fitted to a phalange by deformations of a provided excess of band material.

It should be noted that the clasp 56 may be broadly adapted to a variety of sizes by the provision of an excess of material in the band extension 60, as indicated in FIG. 2*a.* This is especially adaptive to materials, such as the exampled polycarbonate, which may be cut by scissors or other simple tools. A single form of the picks having an excess band extension 60 can be effectively fit to the thumbs and fingers of a broad range of players. The sheet form of the pick may moreover provide a general excess of material in other of its parts and aspects, to permit a range of adaptations to be effected by the user.

Figure 2B:
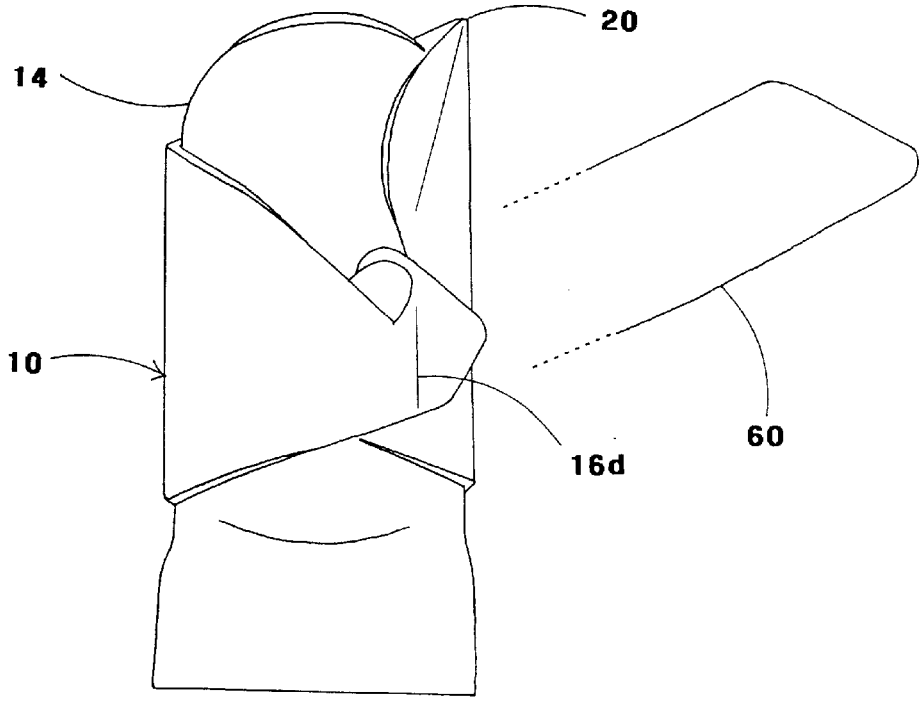
FIG. 2*b* shows the securable instrument pick of FIG. 2*a* as it might be facilely deformed to fit a distal phalange.
Figure 2C:
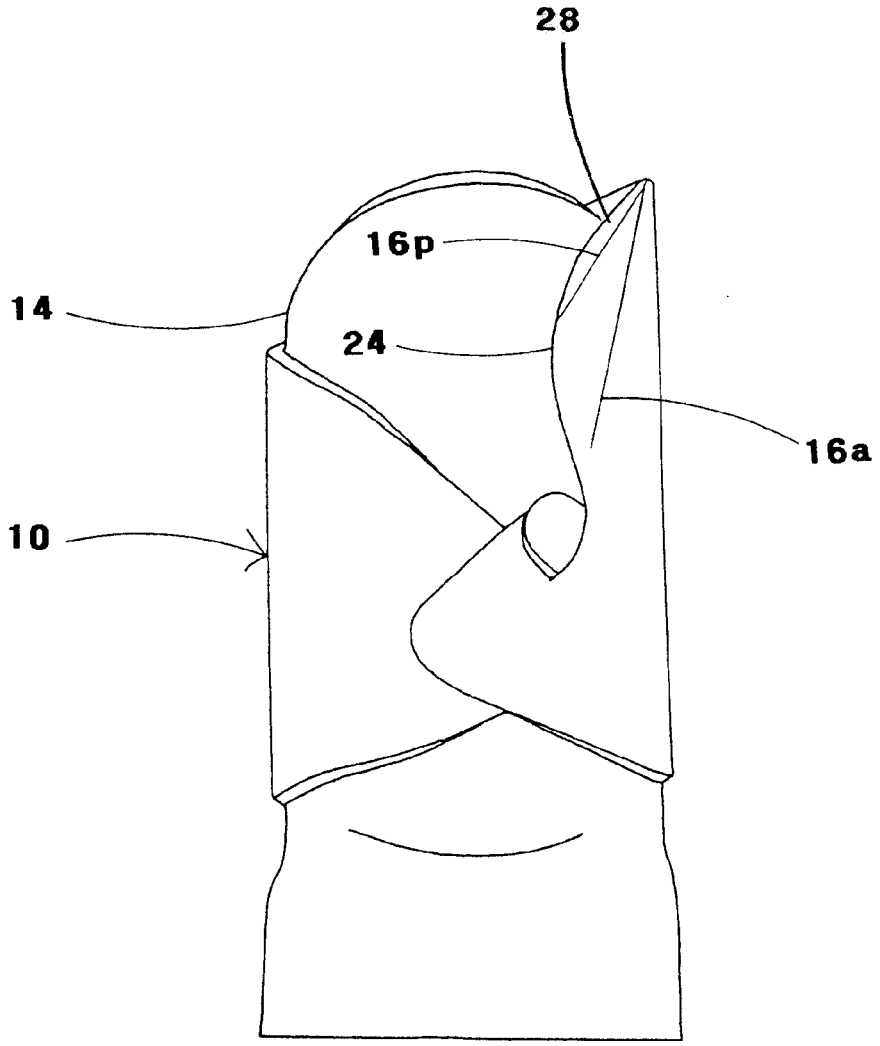
FIG. 2*c* shows the securable pick clasped as is preferred for use on the phalange of a thumb, and having a memorable bend placed in the lower surface presentation of its tip.

FIG. 2*b* shows how a secondary opposable notch 54 may be placed to fit a pick to a distal phalange, and excess band material 60 trimmed. It is currently preferred that a pick fitted for use on a thumb be clasped in this relation, with the secondary notch 54 in the outer position, as shown in FIG. 2*c.* The material remaining beyond the notch may be memorably bent to lay flush on the outer surface of the pick, by a bend such as 16*d,* or by additional bends, not shown.

Figure 3B:
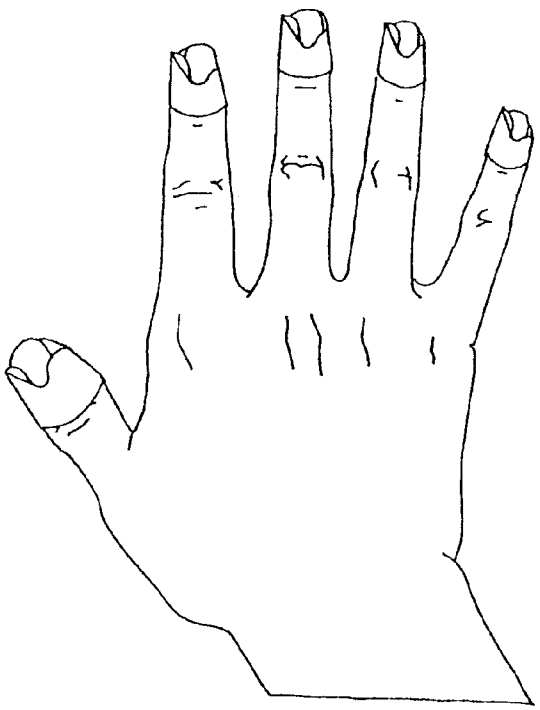
FIG. 3*b* shows a view of the picks worn on the thumb and fingers, in a view of the upper surface of the hand.
Figure 3A:
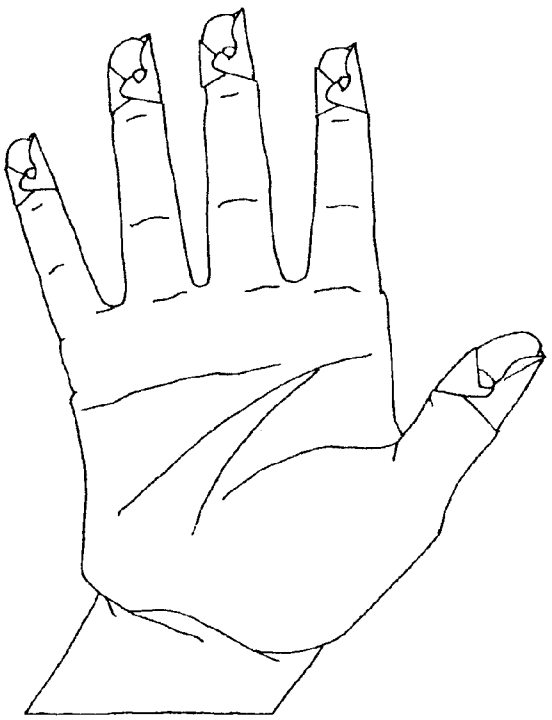
FIG. 3*a* shows the securable instrument picks worn on the thumb and fingers of a hand, in a view of the underside of the hand.

A pick fitted for use on a finger is alternately preferred clasped with the secondary notch 54, after it has been placed, subsequently tucked under the primary notch 52, as shown in FIG. 1*c,* and 1*a,* considered sequentially. The material of the outer component of the clasp is in either case bent to lay flush. This overall arrangement, which is indicated in FIG. 3*a,* prevents any snagging of the clasps which might occur in actions of playing involving both the thumb- and finger-picks. FIG. 3*b* shows an alternate view of the upper surface of the hand.

In fitting the picks it is advisable to begin with the thumb, so that if the secondary notch is misplaced, there remains sufficient band material to fit the pick to a smaller finger. It is also helpful to over-estimate the placement of the notch, making the pick slightly tighter than ideal, since the notch can be cut further, and turned toward the extension of excess band, to loosen the fit. The primary notch could also be deepened somewhat. The depth of the secondary notch will affect the fit not only in respect to size but also its shape. The shallower the depth of the notch, generally, the more acutely conical the ring portion, diminishing toward the fingertip. It is desirable that the pick be fitted generally flush to the shape of the phalange, and not flared toward the distal joint. It is also possible to employ several demi-notches, branching from a primary notch, to effect slightly variable fits. A pick employed for producing alternating up- and downstrokes by a finger, according to the invented method, may be preferred slightly tighter than a pick which is to be employed for example only for upstrokes of a finger. The picks may be deformed and adapted in numerous ways.

Because the preferred embodiment is formable and adaptable in the manner described it can be readily produced in a booklet form, including stamped patterns of the invented picks in sheet material, and instructional references for forming, fitting, and using the invention. Therefore a great many variants may be inexpensively produced, obtained, and used, by a broad range of players having different preferences and needs.

The preferred embodiment described in reference to FIGS. 1*a*–3*b* provides a string-actuating tip in a mechanical relation of an off-set cantilever through the pick to the upper or lower pads of the phalange. In the operation of the pick, the pressures resulting from a stroke upon a string are carried through against the phalange. In this particular embodiment the upper and lower surface presentations may also seem to brace the actuating tip somewhat against the respective surfaces of the phalange. This is not generally necessary, however. Moreover, if the tip should seem to shift slightly in respect to this bracing, it is currently preferred that it may do so. This flexing of the cantilever is thought to reduce the motion required of a finger in a stroke against a string. The cantilever in this embodiment is more strongly effected in strokes against the lower presentation of the actuating tip, although this is not the case in other possible embodiments. This embodiment is preferred in respect to introducing the novel picks, and its combination of advantages is considered, in an overall, averaged sense, to be preferred at this time. The upstrokes of fingers and downstrokes of the thumb are generally more customary strokes, both of which present the lower surface toward strings, and this version of the pick may be found in some respects to be balanced toward such applications in terms of its novel mechanics. My provisional patent application Ser. No. 60/081416, filed Apr. 11, 1998 discloses several among the many other embodiments which have been found effective, but which are not enumerated or recited here.

Figure 4A:
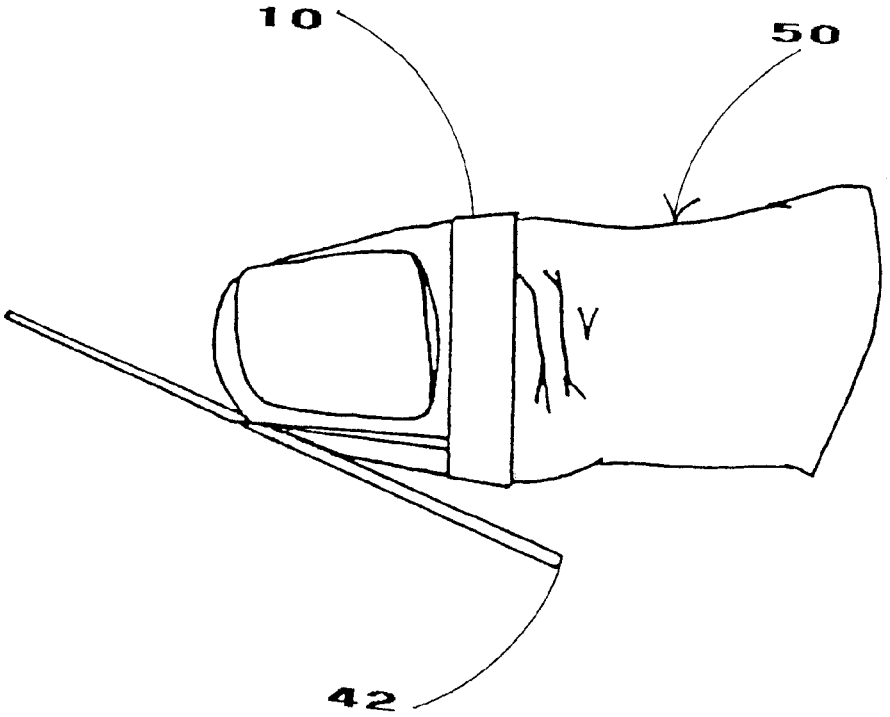
FIG. 4*a* shows an elemental embodiment of a securable instrument pick employed by a thumb to engage a string in a novel combined stroke of the thumb and tip.
Figure 4B:
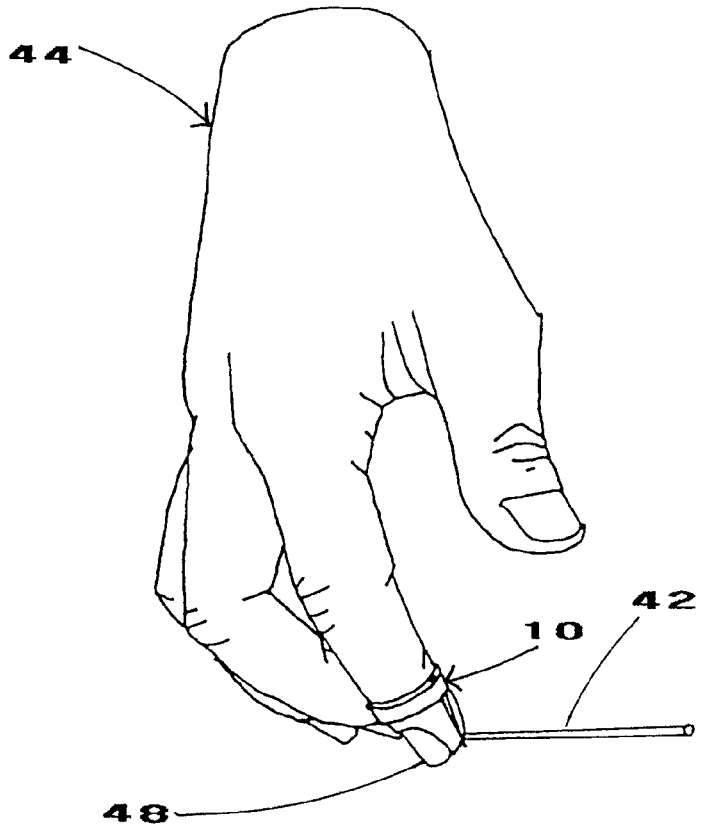
FIG. 4*b* shows the elemental embodiment of the pick employed by a finger to strike a string in a novel combined stroke of the finger and tip.
Figure 4C:
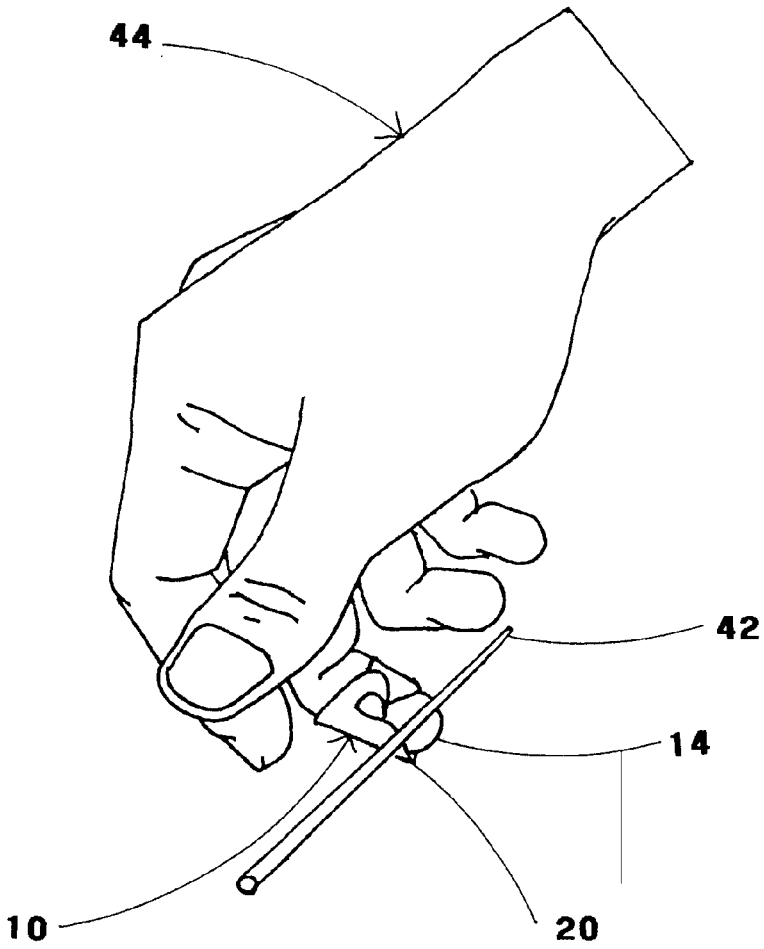
FIG. 4*c* shows the preferred embodiment of a pick employed by a finger to strike a string in a novel stroke.

FIGS. 1*a* and 4*c* show views of a distal phalange as it might engage against a string 42. In FIG. 1*a* the phalange 14, the pick 10, and the string can be understood as they might pertain to strokes performed by a finger or thumb. In either case the pick is seen to co-act in a uniquely conjunctive relation with the exposed phalange to engage against the string. That relation can be readily understood to be variable in respect to the relative co-action of the pick 10 and phalange 14. The pick can in some cases engage the string independently, and it has also been found that the bare fingertip can strike the string without contact by the actuating tip, if the hand is tilted sufficiently, and the tip is adjusted properly.

The pick may be filed or deformed to variously co-act with the exposed phalange. But a player should avoid creating an undercut angle in the lower presentation, near the tip, in the case of the thumbpick. This makes it possible for a string to snag under the tip. The length of the tip should usually be controlled by the securement. If the tip must be cut shorter, to adapt a large form of the pick to a relatively small finger, it is a good method to begin with the unbent sheet material, or else to re-flatten the tip, and clip away the excess material from the tip in an even curve, then position the bends to taper directly to the point of termination. A malformed tip may undesirably click or scratch against strings. It may be difficult to shorten the tip effectively in this embodiment by simply clipping the end.

Small additional bends can be placed in the surface presentations, effecting faceted presentations in the tips, which can alter the action of the tips, in minute, but appreciable, and sometimes desirable ways. FIG. 2*c* shows a pick with a bend 16*p* added to its lower surface presentation 24. The bend 16*p,* in the same direction as bends 16*a–o,* effects a forward surface presentation 28 of the tip 20. The forward surface presentation 28 has been found advantageous in respect to playing actions of the thumb, especially. In particular, the forward presentation 28 facilitates playing actions of the thumb such as alternations of thumbstrokes with strokes of a finger upon a string, and other actions wherein the thumbtip may independently extend to strike a string without repositioning the hand. Although the forward presentation 28 might obviously be effected in other versions of the picks, the bend 16*p* is here an example of one of the adaptive deformations permitted by the preferred embodiment. It may be noted also that the bend 16*p* is also an effective alteration of the fingerpick, in that it alters the feel of the stroke for the player. And further, a bend in the position of 16*p* which is produced in the opposite direction of the bends 16*a–o,* is also an effective variation of the action of the pick. Still further, some or all of the tip material may be variously removed, by clipping or filing. For example, a player employing only upstrokes of the fingers, and downstrokes of the thumb, might remove upper surface presentation material from some or all of the picks. This seems to affect the tone of the attacks, and may be felt to have other benefits in respect to some applications. In these and other ways the sensitive co-action of the picks may be adapted or adjusted.

The method currently preferred in respect to the novel combined stroke is that of a simultaneous engagement of tip and flesh upon a string, and a simultaneous release of the string also by both elements. This preference is general, rather than uniform. The general application of this method serves as a facile and tactile reference point, in playing, as toward deviations from it which are advantageous within musical contexts.

The method of employing the invented strokes is advantageously adaptive, in many general respects, to the example of the classical guitar method. These respects include the general motions of the fingers and thumb, and their orientations toward strings in regard to the position of the hand. The invented method is therefore seen to be adaptive to combinations with conventional methodology. Persons skilled in the art will no doubt recognize that the invention has many other adaptive possibilities.

FIG. 4*a* shows an elemental embodiment of the invented picks comprising a ring-shaped securement band, and a rigid pin projecting forward, to the side of the distal phalange of a thumb. This example of a thumbpick in an elemental form illustrates the pertinence of a generally forward presentation of a tip to the invented combination stroke. The tip might be provided in such a relation to the phalange by many other sorts of securements or forward extensions.

FIG. 4*b* shows the elemental embodiment employed by a finger to strike a string. Again, the pertinence of a generally forward presentation of a tip is demonstrated, although that presentation might be achieved in countless other ways.

FIG. 4*c* shows the embodiment currently preferred in the action of a stroke against a string. The co-active relation of a tip to the phalange as demonstrated in FIGS. 4*a–b* can be seen to pertain to the preferred embodiment.

The preferred embodiment previously described is also effective for use in respect to a second novel method. In this application the invented pick, secured on a finger, is employed for variously alternating up- and downstrokes against a string or strings. The upper and lower surface presentations of the tip, to the side of the finger, are deployed to engage against the strings without requiring a supportive grasp of the pick by the thumb.

The middle finger is preferred for reasons including its relative length, its strength, and position. But other fingers can perform the method.

Figure 5A:
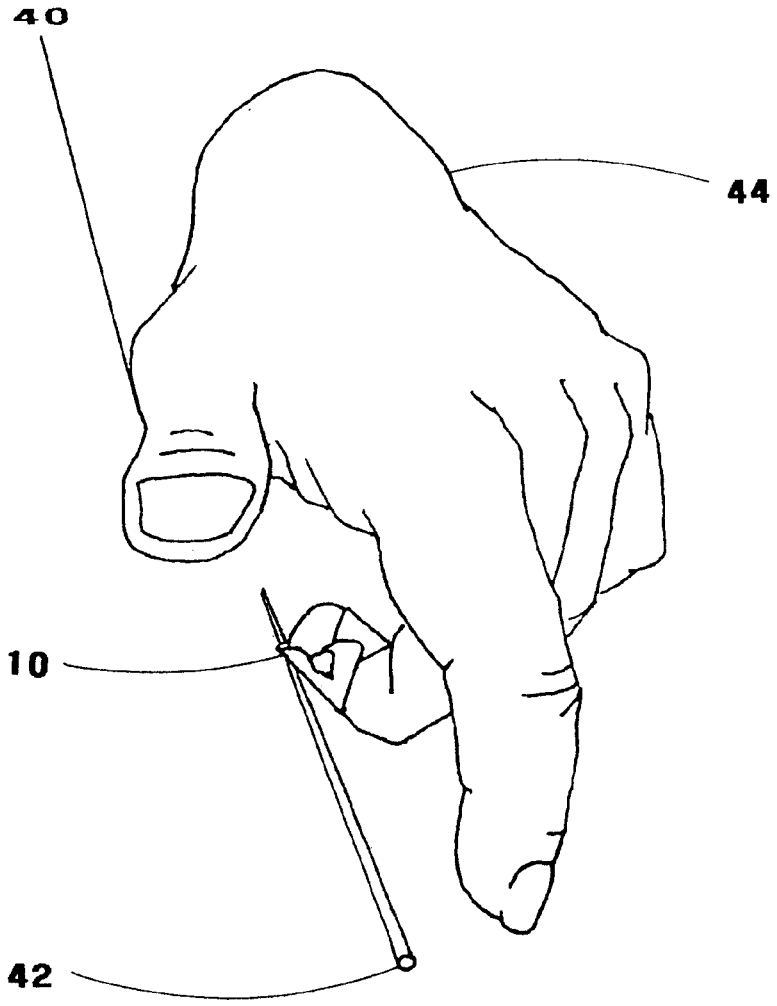
FIG. 5*a* shows the preferred embodiment of the securable picks employed by a finger to strike a string in respect to a novel method of producing up- and downstrokes.
Figure 5B:
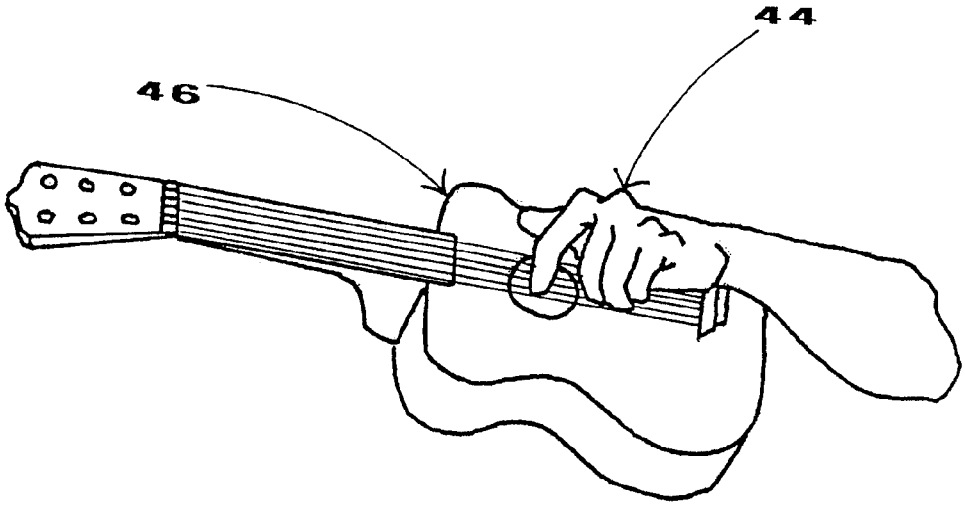
FIG. 5*b* shows a frontal view of a hand employing the novel method to sound the strings of an instrument.

Referring now to FIGS. 5*a* and 5*b* the hand 44 is tilted thumbside toward the string(s) 42. This relation supports the motion of a finger axial to the hand to remain closely oriented within a picking range of the string and adjacent strings, and conversely inhibits the finger from flicking outward or away from the strings, subsequent a stroke.

The thumb 50 is usually rested, or anchored, on the instrument 46. This further supports the orientation of the playing motions toward and among the strings. The thumb may also be rested on strings which are not immediately being sounded, and can be smoothly rolled off those strings when they are to be played.

Figure 5C:
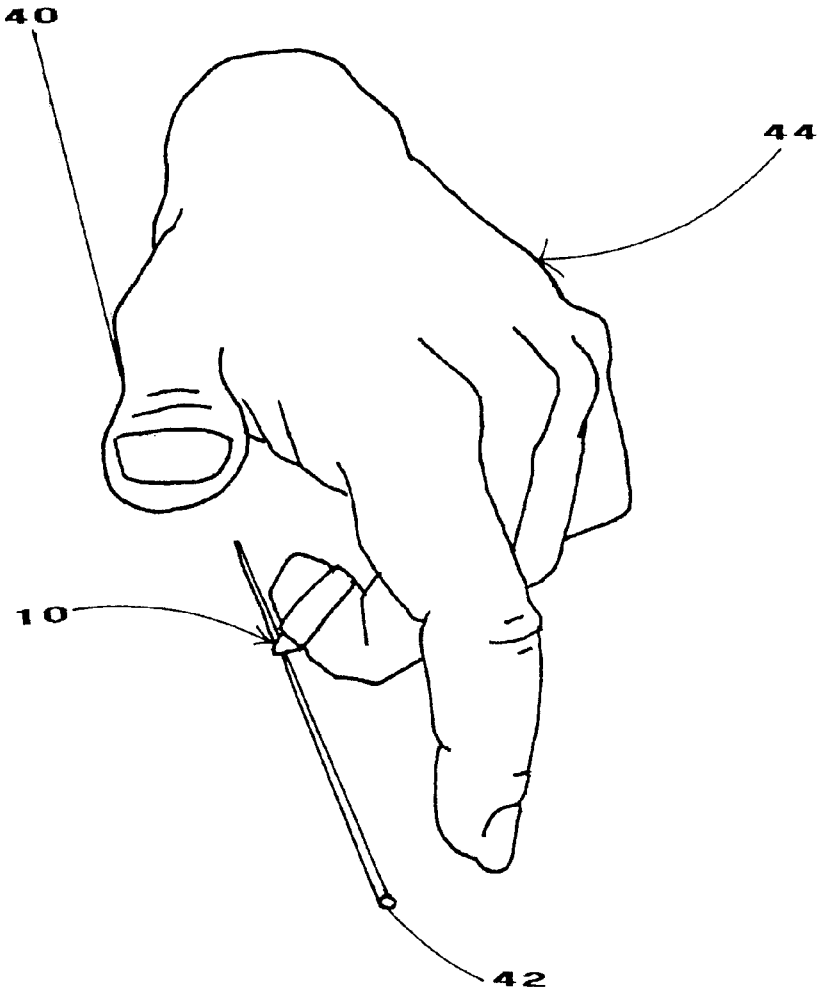
FIG. 5*c* shows an elemental embodiment of a fingerpick, having a sideward presentation of the tip, as employed by a finger to strike strings.

The plane of rest of a hand upon an instrument or its strings is indicated in FIGS. 5*a* and 5*c* by a line 40.

FIG. 5*c* shows an elemental embodiment of a fingerpick, comprising a ring-shaped securement band, integrally presenting a rigid sideward actuating tip. FIG. 5*c* serves to demonstrate the pertinence of a sideward presentation of a tip to the application of the novel method of producing up- and downstrokes. The playing strokes of this invented method generally do not incorporate the touch of a fingertip upon the strings, as the anchoring of the hand upon the instrument effectively supports orientation toward the strings. The co-action of the fingertip, while it is possible within the scope of this method, is of circumscribed interest, only as it pertains to musical phrasing.

The invented method of performing alternating strokes with a finger has areas of advisable limitation. It is not preferred nor well-advised to play this way at as high an acoustic volume as one might achieve with methods initiated more particularly in the wrist. The downstroke of the invented method should be developed in an unforced and relaxed manner. The motion of the finger in the downstroke is one which is generally less exercised in most persons, and it may need some time to develop. String -actuating tips employed in this invented method must in every adaptation be properly angled in respect to the strings. A tip which snags even slightly against the string will unnecesarily tire and strain the finger.

The upstroke of the finger will generally be found to be the stronger stroke in the development of the technique. But a player may find it is advantageous to develop the downstroke for use on the so-called downbeats or strong beats of musical phrases. The downstroke can also be effective in applications of succesive strokes which do not alternate with an opposite stroke. These applications are common in popular music. The development of downstrokes for the strong beats may be found advantageous in respect to combining the method with another method, such as the invented method of fingerpicking, or another method. But a player may adapt the application of the strokes in whatever way seems most effective.

If the hand is tending to bounce when performing the method, it is not sufficiently tilted sideward.

The essential applications of the novel methods can be understood as pertaining to the preferred embodiment in consideration of applications illustrated in FIGS. 1*a,* 4*c,* 5*a,* and 5*b*. The embodiment of the picks currently preferred facilitates the combination of the invented methods in an inclusive general method of playing, which is the preferred embodiment of the invented method.

Persons skilled in the art will no doubt appreciate that many advantageous embodiments are possible within the scope and spirit of the present invention.

Figure 6:
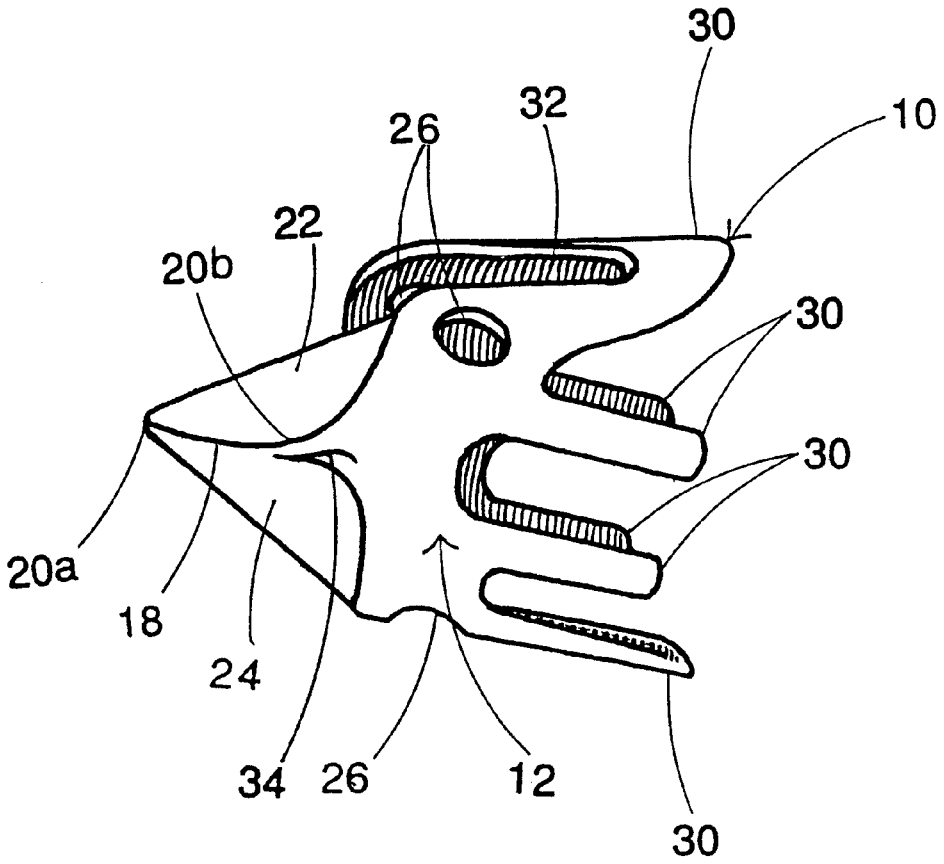
FIG. 6 shows a perspective view of an alternative embodiment of a securable instrument pick, having faceted presentations of both a forward and a sideward actuating tip, in respect to applications against strings.

One example of a variant form of a pick is shown in FIG. 6. In this pick aspects of the elemental embodiment of FIGS. 4*a–b* and the elemental embodiment of FIG. 5*c* can be seen to be particularly combined. As a fingerpick this pick is advantageous in respect to applications combining the novel methods. The upper and lower presentations taper toward a forward tip, 20*a* and a sideward tip 20*b* is also presented integrally, thereby providing flexibility in respect to applications against strings. The preferred embodiment of FIG. 1*a* can be understood to also provide a forward tip having a sideward aspect, but the alternative embodiment of FIG. 6 extends the sideward ridge in degree. The sideward aspect of the tip, 20*b* comprises a generally rearward, inclined surface presentation 34, for engaging against a string by a finger positioned as shown in FIGS. 5*a–c*. Surface presentations such as the rearward inclined presentation 34 can be considered as adaptive facets of the invented sideward actuating tip 20. The form of the tip 20*a–b,* and 34, shown in FIG. 6 has been found effective in reducing motions of a finger, when performing up and downstrokes, by providing continuous aspects of the tip 20 to the side of the finger. The limitation of this enhanced sideward tip 20*b* is in the degree to which it may encumber the motions of an adjacent finger. But a player might in some cases employ a pick with the enhanced sideward presentation 20*b* on the middle finger, for example, and picks according to the preferred embodiment on the other fingers and thumb.

The alternative embodiment in FIG. 6 has additional provisions of its ring portion 12, including holes 26, extensions 30, and invaginations 32. The holes, extensions, and invaginations effect enhancement of the grip of the ring upon a phalange, and serve to disperse pressure of that grip.

Figure 7B:
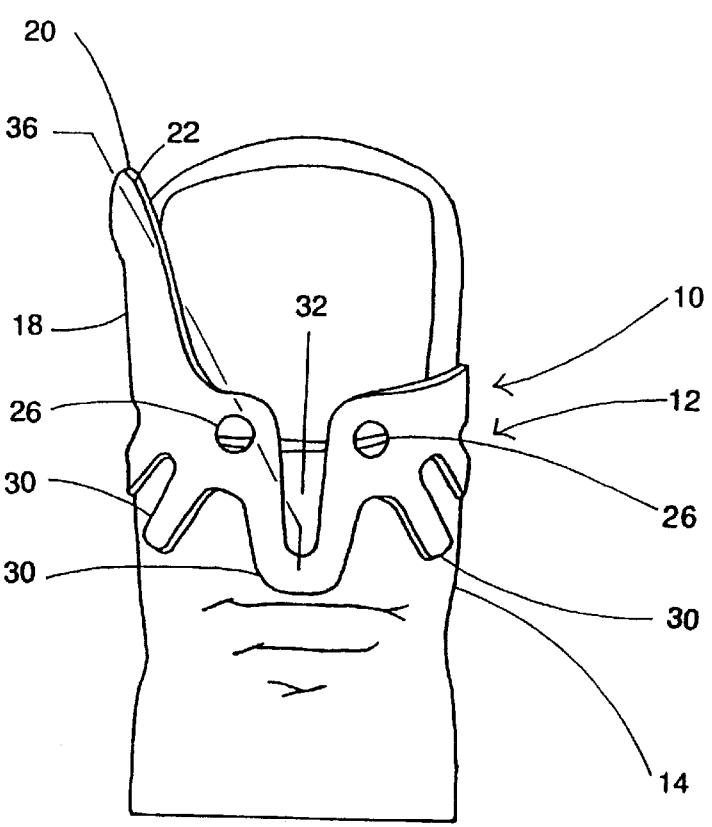
FIG. 7*b* shows the pick of FIG. 7*a* in a view toward the upper surface of the phalange.
Figure 7A:
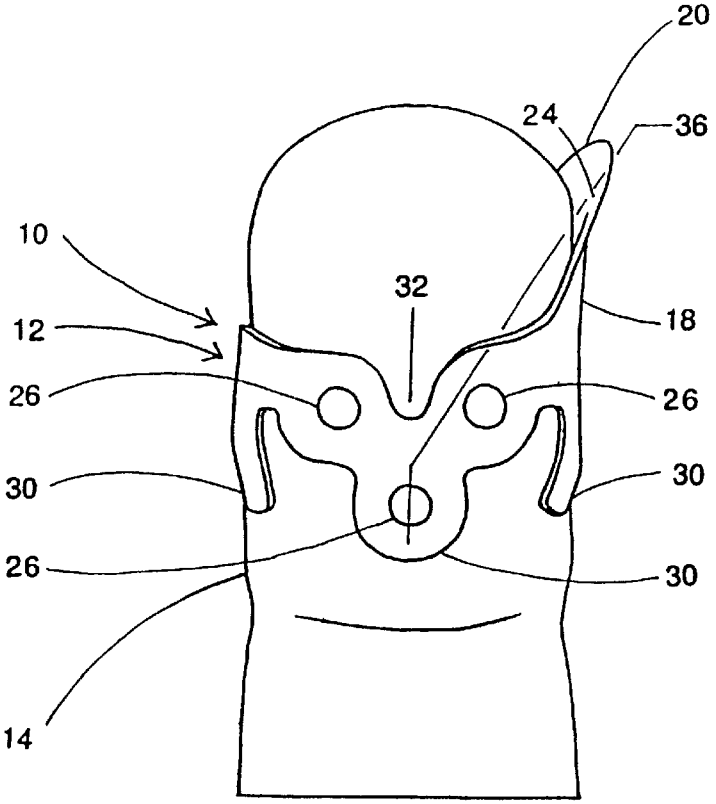
FIG. 7*a* shows another alternative embodiment mounted on a distal phalange in a view toward the underside of the phalange. The general course of cantilevered pressure through the pick is indicated by a line.

FIGS. 7*a* and 7*b* show alternate views of an early embodiment of a pick. The provisions of this embodiment can be understood in respect to aspects and provisions previously recited. The course of cantilevered pressures carried through the pick, against the phalange, has been generally indicated by a line 36.

Figure 8A:
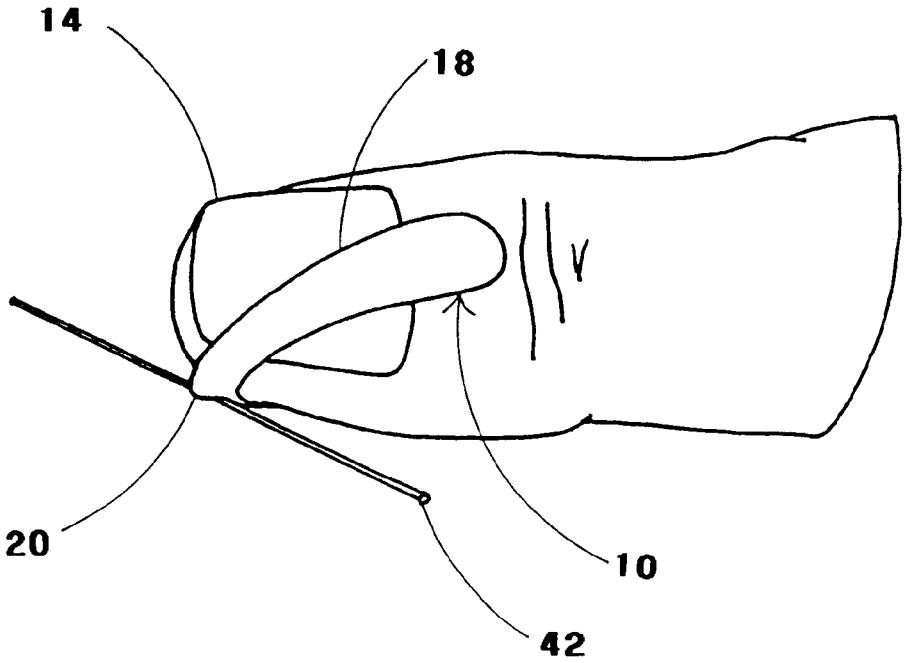
FIG. 8*a* shows an alternative embodiment of the invented picks comprising a string-actuating tip and a U-shaped forward extension, having upper and lower segments, braced upon a distal phalange.
Figure 8B:
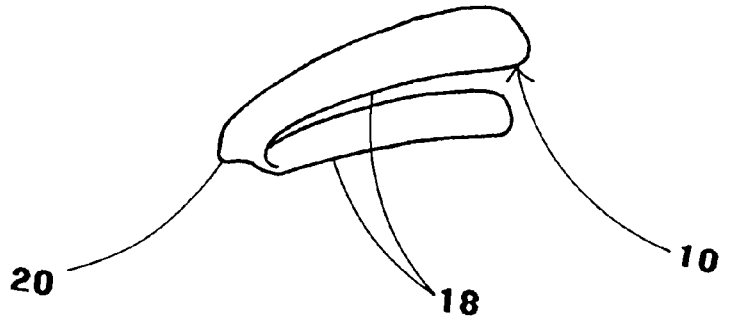
FIG. 8*b* shows the pick of FIG. 8*a* in a perspective view.
Figure 8C:
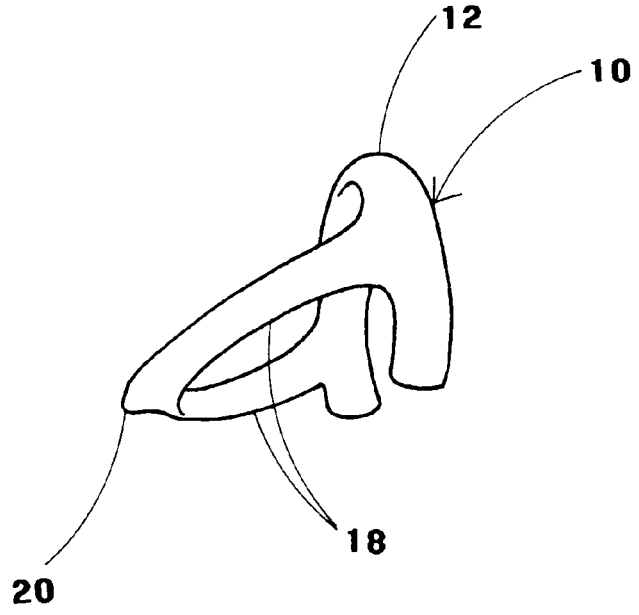
FIG. 8*c* shows a pick having a U-shaped forward extension providing also a ring portion for partially encircling a distal phalange.

FIG. 8*a* shows an alternative embodiment of a pick which is secured on the distal phalange without any ring portion imposed to the sides of the phalange. This can be accomplished in materials having sufficient rigidity and memory, such as metals or thermoplastics. Effective versions may be effected with bent wire, for example. A forward extension 18 is provided in a U-shaped form, which braces the tip 20 in a sideward position on the phalange 14. FIG. 8*b* shows a perspective view of the pick with the U-shaped extension. The upper and lower segments of the extension 18 enact the cantilevering of pressures against the phalange. The advantages of this securement must be weighed against its limitations in respect to maintaining a secure position on the phalange, especially in vigorous playing. Once properly positioned and memorably clamped, it is effective for a range of playing purposes. FIG. 8*c* shows one example of how the grip of the U-shaped extension might be additionally provided with extensions of a ring portion 12, to enhance the stability of the pick, and facilitate the proper positioning upon a phalange. The embodiment shown in FIG. 8*c* has unique advantages also for uses as a thumbpick. The positioning of the ring portion 12 away from the actuating tip 20 permits closer proximity of the thumb to the strings without risk of buzzing against a string which is vibrating. Therefore, again it is seen that the preferred embodiment of FIGS. 1*a–*3*b,* while it provides many advantages in a single form of the invention, may have other more particularly adapted variant forms. The embodiment shown in FIG. 8*a* cannot satisfactorily be produced in material such as the exampled 0.020 sheet polycarbonate, but must be formed in more resilient materials, or by mold-injection.

Figure 9A:
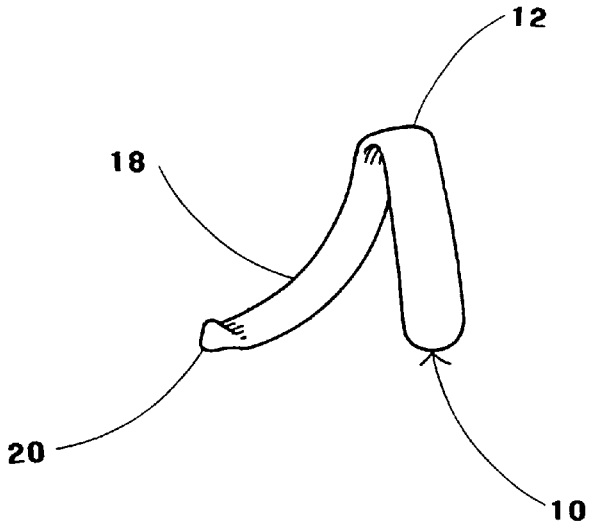
FIG. 9*a* shows another alternative embodiment comprising a forward extension from a ring portion toward a string-actuating tip.
Figure 9B:
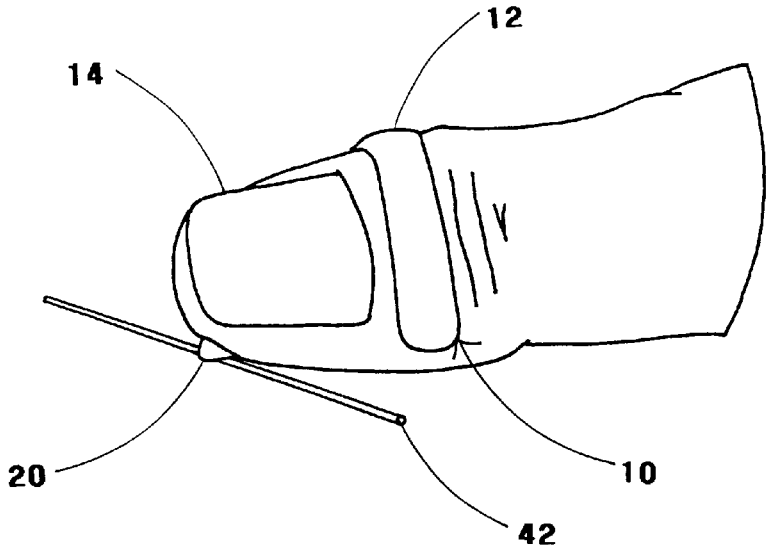
FIG. 9*b* shows the embodiment of FIG. 9*a* as mounted on a distal phalange; and, FIG. 10 shows an embodiment combining an actuating tip in the conventional form of a false nail integrally with a tip according to the present invention.

FIG. 9*a* shows another embodiment of a pick mounted on a distal phalange. FIG. 9*b* shows a perspective view of this embodiment. A ring portion 12 partially encircles the phalange 14 and a forward extension 18, under the phalange, supports the string-actuating tip 20 in its position for use. The provided relation is adaptive as a thumpick for performing downstrokes, or as a fingerpick, for upstrokes. The pick is adaptive for application of the invented combined stroke of flesh and tip, although it is here depicted engaging the string 42 by the tip 20 discreetly from the flesh of the phalange. The scope of invention can generally be understood to include discreet strokes of the pick tips.

Figure 10:
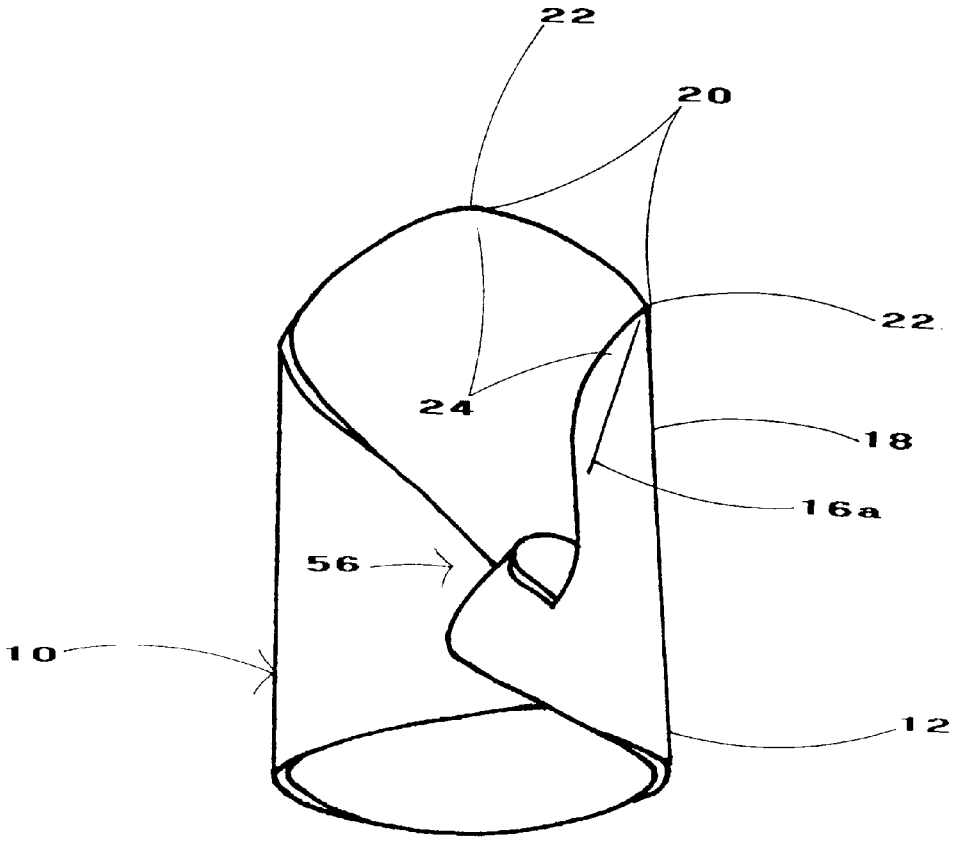

FIG. 10 shows another embodiment of a pick having provisions according to the preferred embodiment, and having integrally combined with these, an extension of the upper presentation 22 in the form and position of the natural nail. The pick can be understood in respect to the memorable bends such as 16*f* and 16*i*, which extend only partly across the band material, so that the band may be formed, yet a curved and unfaceted nail-like ridge may be presented in a position over the natural nail. This embodiment serves as an example of one of the many ways the present invention can be readily combined with aspects of known picks and methods.

From the above description and drawings persons skilled in the art will appreciate that the present invention provides a novel general type of instrument pick, which has many possible embodiments and applications. From the description and drawings provided, persons having ordinary skills will be able to make and use versions of the invented picks. Further, the above discussion provides insight into the underlying principles and mechanics of the invention, which may be applied to in respect to numerous other effective embodiments. The novel methods facilitated by the invented picks are also herein disclosed and discussed.

I claim:

1. A method of enhancing the natural form of a distal phalange of a digit of a hand for use in strokes against the strings of a musical instrument, said method comprising the steps of;

a. providing an effectively rigid directional picking element adapted to be fitted against an edge of said distal phalange, in a generally parallel offset position alongside the directional picking end of said phalange;

b. providing a material means for securing and maintaining said picking element in said position;

said means including a resilient material band adapted to substantially encircle said distal phalange;

c. combining said picking element and said securement means in such relation that said directional picking element when secured by said means in said position is effectively supported to enact a substantially simultaneous stroke against one or more said strings alongside a said stroke directed against said one or more strings by said picking end of said phalange;

whereby said natural form of said phalange may be advantageously combined in said strokes with the parallel co-action of said picking element secured in said generally parallel offset position.

2. The method of claim 1 wherein said picking element is further adapted to substantially expose said picking end of said phalange alongside said picking element in said offset position.

3. The method of claim 1 wherein said picking element is further adapted to substantially conform against the circumference of said phalange when fitted in said position.

4. The method of claim 1 wherein said method further comprises the steps of fitting and securing said picking element in said position on said phalange, and directing a parallel co-action of said picking end of said phalange and said picking element in a said stroke against one or more said strings.

5. The method of claim 1 wherein said method more particularly comprises providing a resilient sheet material shaped to integrally combine said picking element and said band in said relation when said said material is bent around said phalange.

6. The method of claim 1 wherein said method more particularly comprises providing a plastic sheet material shaped to integrally provide said offset picking element and said band in said combined relation, said sheet material being adapted to be fitted to said phalange by the step of indicating a pattern of generally forward linear bends in said sheet material;

whereby a laterally flexible, resilient band may be advantageously effected, and an effectively rigid, generally forward directional picking element may be advantageously effected in said sheet plastic material.

7. The method of claim 1 wherein said step of combining said picking element and said band more particularly comprises adapting said effectively rigid material picking element to be firmly connected to said resilient material band in said relation;

whereby separate materials distinctly preferred for said band and said picking element may be employed to enhance said form of said phalange.

8. The method of claim 1 wherein said digit is a finger of said hand, and wherein said method further comprises the steps of securing said picking element in said position on the thumbward said edge of said distal phalange, disposing said edge of said phalange toward said strings, further disposing the thumb of said hand away from said picking element in said position, and sounding said strings by the motions of said finger directed variously up and down against one or more said strings.

9. A pick for enhancing the natural form of a distal phalange of a digit of a hand in strokes directed against one or more strings of a musical instrument, said pick comprising;

a. a resilient material band adapted to substantially encircle said distal phalange, and comprising a dorsal end, a front end, an inner surface, and an outer surface;

b. a directional picking element comprising an effectively rigid material form depending forward from said band, and adapted to be fitted to an edge of said phalange in a generally parallel, offset position alongside the directional picking end of said phalange;

said forward direction of said picking element comprising in forward order a lower outer surface having a length extending to a terminating tip;

said length of said lower surface and said tip lying in said generally parallel, offset position alongside an undersurface length and termination of said picking end of said phalange when fitted to said edge of said phalange by said band, for use;

said picking element further comprising an upper surface generally opposite said lower outer surface, an inward surface lying toward said edge of said phalange when said pick is fitted in said position, and a sideward outer ridge lying substantially opposite said inward surface, and extending generally forward to said terminating tip;

whereby said parallel offset pick is provided to enhance said distal phalange in said strokes against said strings.

10. The pick of claim 9 wherein said pick further comprises an evacuated area, or hole, substantially continous alongside said picking element, and exposing said undersurface length and termination of said picking end of said phalange when said pick is fitted in said position.

11. The pick of claim 9 wherein said picking element comprises a substantially conforming overlay of the circumference shape of said phalange when fitted in said position.

12. The pick of claim 9 wherein said picking element comprises a conforming overlay of the circumference shape of said phalange when fitted in said position, substantially within the conforming range of a cylindrical draft drawn forward from said outer surface of said dorsal end of said material band.

13. The pick of claim 9 wherein said inward surface and said sideward ridge comprise substantially parallel lengths extending forward to said terminating tip.

14. The pick of claim 9 wherein said picking element comprises a substantially narrow and rigid material form extending forward from said band, and substantially conforming to the circumference of said phalange when fitted, said inward surface and sideward ridge comprising opposite edges of said narrow material form, said pick further comprising an evacuated area lying opposite said inward surface, and substantially exposing said picking end of said phalange when said pick is fitted in said position.

15. The pick of claim 9 wherein said picking element comprises a substantially conforming overlay of the circumference shape of said phalange when fitted in said position, said upper surface comprising an outer presentation of said surface at least partially overlaying the fingernailed surface of said phalange, said lower outer surface at least partially overlaying said undersurface of said phalange, said sideward ridge lying intermediate said top and lower surfaces, and defining a substantially acute angle between said surfaces at said termination of said tip.

16. The pick of claim 9 wherein said sideward ridge defines a substantially straight line from the direction of said band to said tip.

17. The pick of claim 9 wherein said sideward ridge further comprises a substantially lesser extension of a sideward tip, integrally with said generally forward length of said picking element, said sideward tip extension lying opposite said inward surface.

18. The pick of claim 9 wherein said pick and said band comprise a shaped sheet material form memorably bent to integrally provide said band and said picking element in said relation.

19. The pick of claim 9 wherein said band is adapted to define against the generally conical circumference of said phalange.

20. The pick of claim 9 wherein said pick further comprises a means of connecting said band around said phalange.

* * * * *